US007033104B2

(12) United States Patent
Corcoran

(10) Patent No.: US 7,033,104 B2
(45) Date of Patent: Apr. 25, 2006

(54) CHIP SEAL METHOD WITH HEATING STEP

(75) Inventor: John Corcoran, Los Angeles, CA (US)

(73) Assignee: Manhole Adjusting Contractors, Pico Rivera, CA (US)

( * ) Notice: Subject to any disclaimer, the term of this patent is extended or adjusted under 35 U.S.C. 154(b) by 0 days.

(21) Appl. No.: 10/253,304

(22) Filed: Sep. 24, 2002

(65) Prior Publication Data

US 2004/0057794 A1 Mar. 25, 2004

(51) Int. Cl.
*E01C 7/06* (2006.01)

(52) U.S. Cl. ..... 404/77; 404/79; 404/82

(58) Field of Classification Search ..... 404/72, 404/75, 77, 79, 82
See application file for complete search history.

(56) References Cited

U.S. PATENT DOCUMENTS 3,965,281 A * 6/1976 Takase et al. ..... 427/139
4,175,885 A * 11/1979 Jeppson ..... 404/77
4,397,263 A * 8/1983 Rio et al. ..... 118/643
4,744,693 A * 5/1988 Smith ..... 404/77
4,815,891 A 3/1989 O'Connor
5,470,176 A 11/1995 Corcoran et al.
5,503,871 A * 4/1996 Blacklidge et al. ..... 427/138
5,556,225 A * 9/1996 Marino ..... 404/77
5,676,895 A * 10/1997 Toivola et al. ..... 264/112
6,186,700 B1 * 2/2001 Omann ..... 404/79
6,217,252 B1 * 4/2001 Tolliver et al. ..... 404/77

OTHER PUBLICATIONS

Public Works Standards, Inc.; "Greenbook" Standard Specifications for Public Works Construction; pp. 105-106, & 258-261; 2000 Edition; Bni Building News; Anaheim, CA.
Thermal Power Corporation; "Road Master M-10 Specifications"; In Place Hot Surface Recycling With the Road Master M-10 Heat Master M-7; May 26, 1992; 15 pages; RM10SPEC.TXT; Thermal Power Corporation; Almont, Michigan.
Thermal Power Corporation; "Heat Master Model HM-7-TRK Truck Unit Specifications"; Jul. 16, 1987; 10 pages; Thermal Power Corporation; Almont Michigan.
Office of the City Engineer, City of Westminster; "Specifications"; 2002-03 City-Wide Crack, Slurry, and Cape Seals Project, Project No. SS-02-03; Aug. 2002; pp. SP-17 to SP-20.

* cited by examiner

*Primary Examiner*—Gary S. Hartmann
(74) *Attorney, Agent, or Firm*—Christie, Parker & Hale, LLP

(57) ABSTRACT

A paving method is provided that includes applying a thermoplastic material to a surface to be paved, covering the thermoplastic material with a layer of aggregate (precoated or otherwise), passing a heater above the aggregate and thermoplastic material, and at least partially embedding the aggregate in the thermoplastic material.

29 Claims, 7 Drawing Sheets

14
12
10
20
5A
5B
32
10
32

CHIP SEAL METHOD WITH HEATING STEP

FIELD OF THE INVENTION

The present invention is directed to a method of paving a surface with a thermoplastic-aggregate membrane. More particularly the present invention is directed to a method of paving a surface by applying a thermoplastic material, such as an asphalt-rubber membrane, to a surface to be paved, covering the thermoplastic material with a layer of aggregate, passing a heater above the aggregate and thermoplastic material and at least partially embedding the aggregate in the thermoplastic material to form a thermoplastic-aggregate membrane.

BACKGROUND OF THE INVENTION

An existing method of paving a surface with a thermoplastic-aggregate membrane involves spray-applying a layer of a thermoplastic material, such as a hot asphalt-rubber mixture, to a surface to be paved, thereby forming a thermoplastic membrane; covering the membrane with a heated layer of aggregate; and rolling (i.e., passing a roller over) the aggregate to embed the aggregate in the membrane.

This prior method has several drawbacks. For example, when the thermoplastic material is asphalt-rubber, in order for the method to be effective, the temperature of the surface to be paved must be at least 13° C. (55° F.) and the atmospheric temperature must be at least 16° C. (60° F.). In tropical climates this is not a major concern, but in cooler climates or in cooler seasons of the year, paving projects can encounter lengthy delays based solely on the weather. In addition, when using this method a danger exists that a paving crew can be sent to a work site and prepare a surface for paving only to encounter a change in temperature due to unexpected cloud movement or the like and be forced to delay construction. In such an instance, crew time, which can cost a paving company approximately $24,000 per day, is wasted.

In addition to the surface and atmospheric temperature requirements, spray-applied asphalt rubber also must meet specific temperature requirements when it is applied to the surface to be paved. The asphalt-rubber mixture must be applied to the surface to be paved at a temperature between 191° C. (375° F.) and 218° C. (425° F.). The mixture may be applied to the roadway immediately following mixing and reacting; however, if it is not used within 6 hours of mixing, the mixture must be allowed to cool below 149° C. (300° F.) for 12 hours, or to ambient temperature for longer periods, and then be uniformly reheated to a temperature between 149° C. (300° F.) and 218° C. (425° F.) (typically between 191° C. (375° F.) and 218° C. (425° F.) at time of placement. Thus, any unexpected delay in construction can severely reduce a paving crew's efficiency.

Following application of an asphalt-rubber layer, the asphalt-rubber material is covered with a heated layer of aggregate which is often precoated with a paving grade or emulsified asphalt. In the existing method, the aggregate must be placed over the asphalt-rubber membrane within 15 minutes after placement of the asphalt-rubber membrane, and must be at a temperature between 127° C. (260° F.) and 163° C. (325° F.). In order to maintain the desired temperature relationship between the asphalt-rubber and the aggregate, initial rolling must commence within 90 seconds following placement of the aggregate in order to embed the aggregate in the asphalt-rubber membrane.

SUMMARY OF THE INVENTION

In an exemplary embodiment, the present invention addresses these problems by providing a paving method comprising: applying a thermoplastic material to a surface to be paved; covering the thermoplastic material with a layer of aggregate; passing a heater above the aggregate and thermoplastic material; and at least partially embedding the aggregate in the thermoplastic material.

Another embodiment of the present invention includes a paving method comprising applying a thermoplastic material to a surface to be paved; covering the thermoplastic material with a layer of aggregate; passing a heater above the aggregate and thermoplastic material to indirectly heat the thermoplastic material; heating the thermoplastic material at least to its softening point; and passing a roller over the aggregate to at least partially embed the aggregate in the thermoplastic material.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF THE INVENTION

Figure 1:
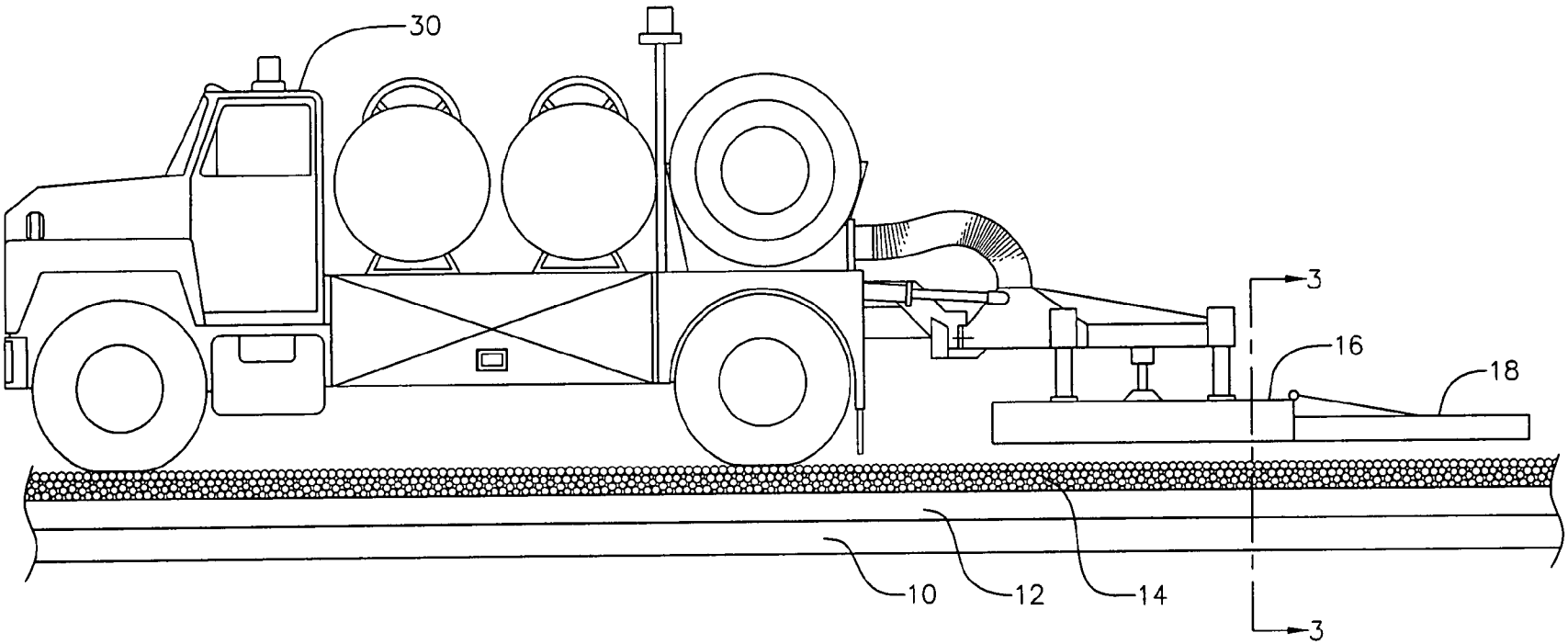
FIG. 1 is a side elevational view of a truck carrying a heater, showing the heater being passed above a surface to which a layer of thermoplastic material and a layer of aggregate have been applied.

As shown in FIG. 1, the invention is directed to a method of paving a surface 10 by applying a thermoplastic paving material 12, such as an asphalt-rubber material, to the surface 10 to be paved, covering the thermoplastic material 12 with a layer of aggregate 14, passing a heater 16 above the aggregate 14 and the thermoplastic material 12; and at least partially embedding the aggregate 14 in the thermoplastic material 12.

Unlike the method of the prior art, using the method of the invention, the thermoplastic material 12 and the aggregate 14 do not need to be within specific temperature ranges as the aggregate is spread over the thermoplastic material 12.

For example, using the method of the invention, the aggregate 14 may be spread at relatively low temperatures, such as ambient temperature, and the thermoplastic material 12 may cool to ambient temperature. Both are then reheated to allow for aggregate 14 embedment by this procedure.

Figure 2:
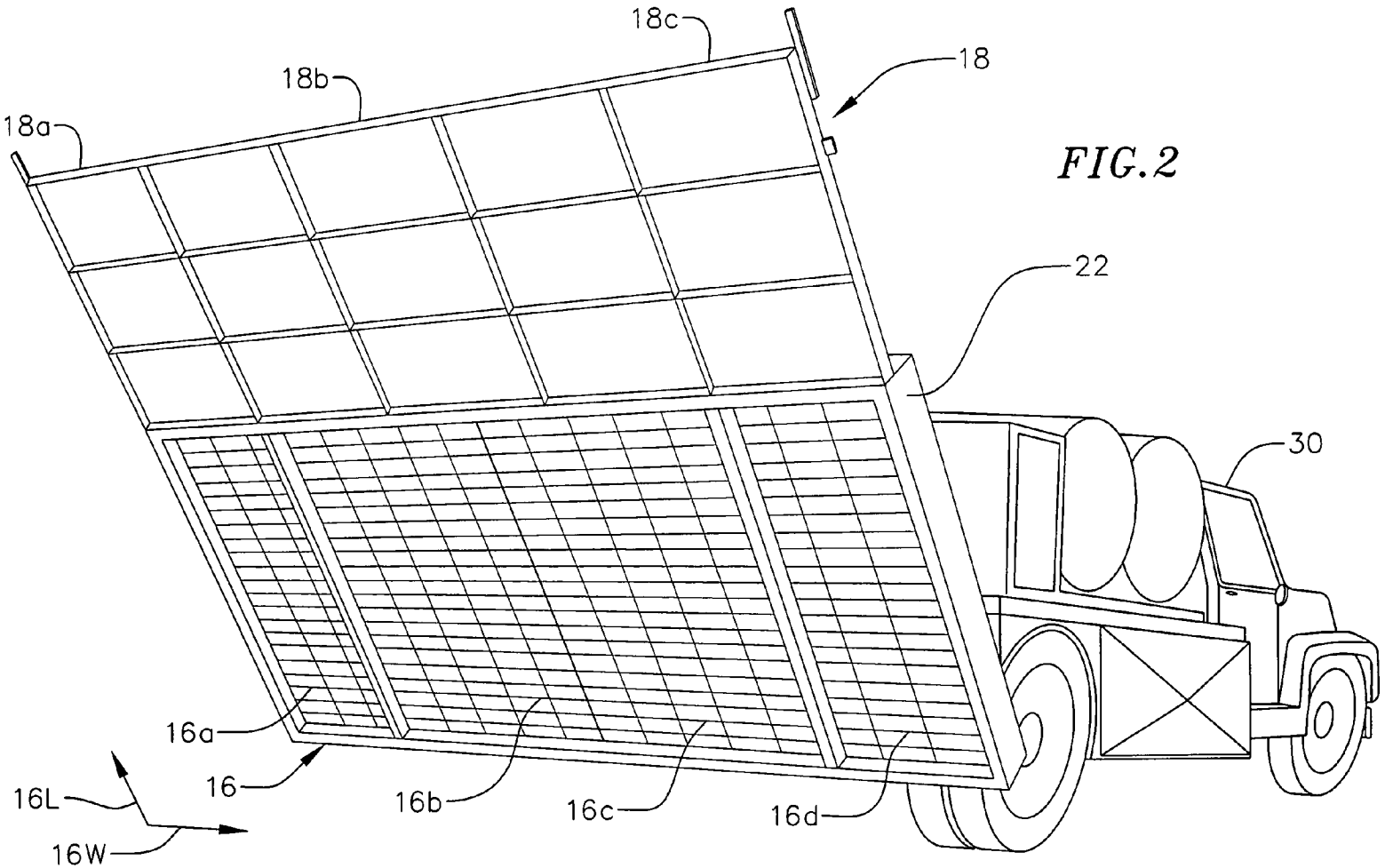
FIG. 2 is a rear perspective view of the truck and heater of FIG. 1.

FIG. 2 shows an embodiment of the heater 16. In the depicted embodiment, the heater 16 is a thermal power luminous radiant heating panel capable of instantly and evenly distributing heat. According to the method of the invention, after the thermoplastic material 12 is applied to the surface 10 and the aggregate 14 is applied to the thermoplastic material 12, the heater 16 is passed above the aggregate 14 and thermoplastic material 12. The heater 16 passes above the aggregate 14 and thermoplastic material 12 at a rate of travel and delivering heat sufficient to raise the temperature of the thermoplastic material 12 to its softening point, typically a minimum of 140° F.

For example, in one embodiment, the heater 16 is capable of evenly distributing heat in a range of approximately five to approximately nine million British Thermal Units per hour over a seventy-eight square foot area and travels at a rate in a range of approximately sixty to approximately ninety-five feet per minute. In one embodiment, the heater 16 is capable of evenly distributing approximately seven million British Thermal Units of heat per hour over a seventy-eight square foot area and travels at a rate of approximately seventy-five feet per minute. At the softening point of the thermoplastic material 12, the aggregate 14 can be at least partially embedded into the thermoplastic material 12, such as by passing a pneumatic roller 20 over the aggregate 14. For example, when the thermoplastic material 12 comprises asphalt rubber as defined in ASTMD 8–88, having a softening point of 140° Fahrenheit, the heater 16 can be used to heat the thermoplastic material 12 to a temperature of at least about 140° Fahrenheit.

The method of the current invention produces several surprising results. For instance, since the thermoplastic material 12 typically comprises an oil, one skilled in the art at the time of the present invention would be surprised that the heater 16 could supply enough heat behind and between the aggregate 14, to heat the thermoplastic material 12 to its softening point without igniting the oil of the thermoplastic material 12. In addition, it is surprisingly not necessary to heat the aggregate 14 in order to at least partially embed the aggregate 14 in the thermoplastic material 12, as long as the thermoplastic material 12 is heated to its softening point.

Figure 3:
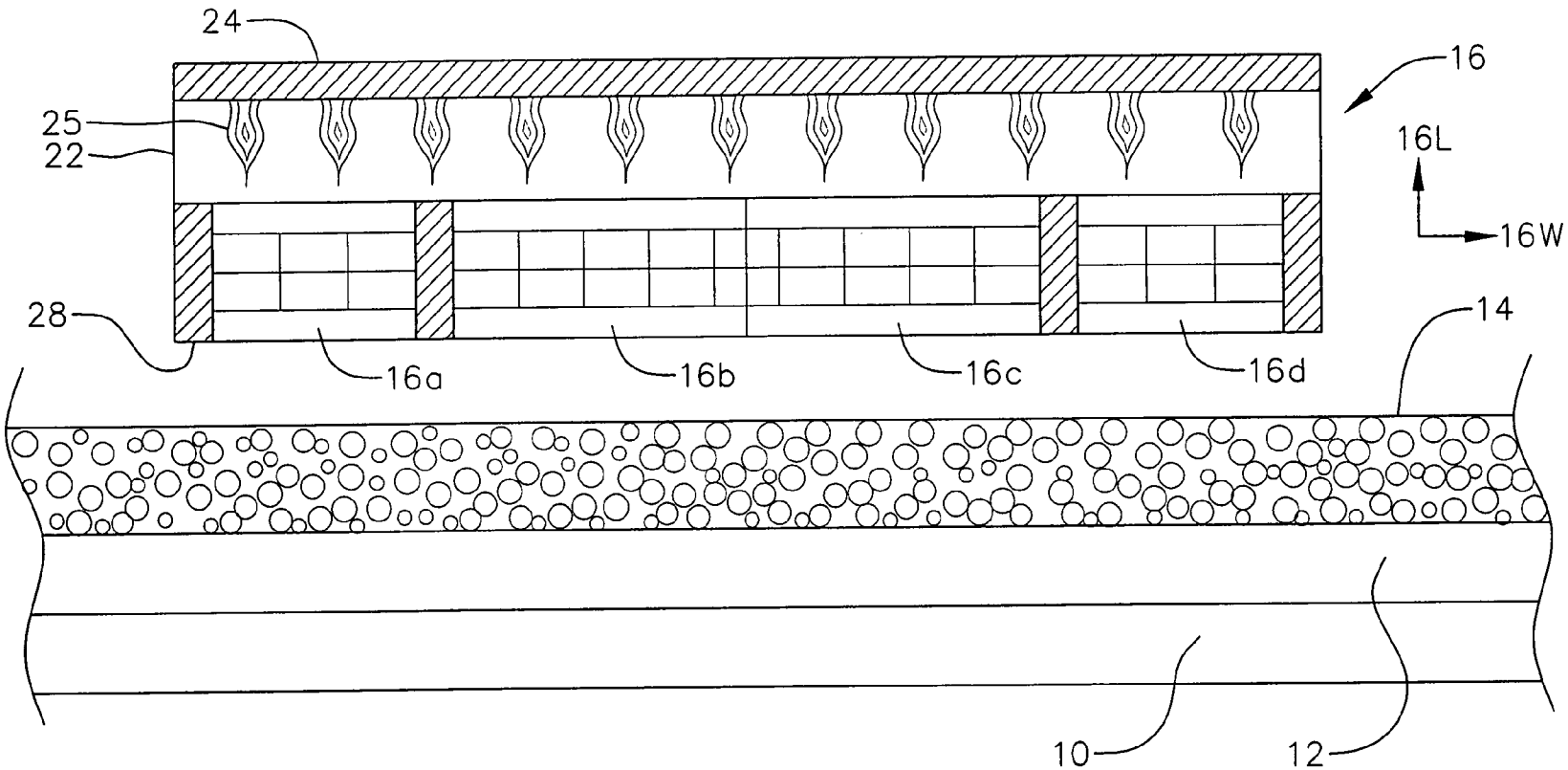
FIG. 3 is a cross-sectional view, taken in the direction of 3—3 of FIG. 1, of the heater and the surface to which a layer of thermoplastic material and a layer of aggregate have been applied.

One reason that the method of the current invention is able to heat the thermoplastic material 12 to its softening point without igniting the oil in the thermoplastic material 12 is that the heater 16 indirectly heats the thermoplastic material 12. In the depicted embodiments of FIGS. 2 and 3, the heater comprises a housing 22. Disposed within the housing 22 is a heat source 24, such as a liquid propane gas ("L.P.G.") fueled open flame burner. Alternatively, the heat source 24 may utilize any of a variety of other suitable fuels, such as liquid natural gas ("L.P.G."). The housing 22 may also contain a plurality of heating bricks 26. For example, the heating bricks 26 may be disposed within the heater housing 22 between the heat source 24 and a pavement facing surface 28 of the housing. Alternatively, the heating bricks 26 may be attached to the heater 16 externally of the heater housing 22 yet still disposed between the heat source 24 and the aggregate 14. Such arrangements enable the heat source 24 to indirectly heat the thermoplastic material 12 since the heating bricks 26 and the aggregate 14 are disposed between the heating source 24 and the thermoplastic material 12. In such instances, when the heating source 24 is activated, the heating source 24 heats the heating bricks 26, which in turn heat the thermoplastic material 12. The heating bricks 26 may be disposed within the heater housing 22 and offset from the pavement facing surface 28 of the housing 22 to further ensure an indirect heating of the thermoplastic material 12 by the heat source 24.

In one embodiment, the heating source 24 produces one or more flames 25. In such an instance, it is preferred that the flame(s) 25 protrude no more than about one inch from the pavement facing surface 28 of the heater housing 22 to decrease the probability that the flame(s) will ignite the oil in the thermoplastic material 12.

In a preferred embodiment, the heater 16 has a width (i.e. a dimension in the direction of arrow 16*w*) in the range of about ten to about fourteen feet. In the depicted embodiments of FIGS. 2 and 3, the heater 16 has a plurality of independently operable zones 16*a*–16*d*. The independently operable zones 16*a*–16*d*, allow the heater 16 to heat a variety of widths. For example, an operator can choose to activate only zone 16*a* when a narrow width of heating is desired, or the operator can choose to active only zone 16*b*, only zones 16*a* and 16*b*, only zones 16*b* and 16*c*, only zones 16*a*–16*c*, all zones 16*a*–16*d* or any other desirable single zone or combination of zones. Although other suitable dimensions are contemplated by the method of the current invention, in the embodiment of FIG. 2, zones 16*a* and 16*d* have a width of about two and one half feet, zones 16*b* and 16*c* have a width of about four feet and zones 16*a*–16*d* have a length (i.e. a dimension in the direction of arrow 16*l*) of about six feet. In this specific embodiment, heating zones 16*a* and 16*d* each produce about 1.32 million British Thermal Units of heat and heating zones 16*b* and 16*c* each produce about 2.31 million British Thermal Units of heat. Although the zones 16*a*–16*d* have been described as independently operable, in other embodiments zones 16*a*–16*d* combine to form one uniformly operable area.

Optionally attached to the heater 16 is an insulated soaking panel 18. The insulated soaking panel 18 may comprise a single panel or a plurality of panels. The soaking panel 18 comprises an insulating material, such as fiber glass battens. The soaking panel 18 helps keep the gases that result from combustion close to the aggregate 14. The soaking panel 18 is preferably divided into a plurality of sections, such as sections 18*a*–18*c*.

Figure 4:
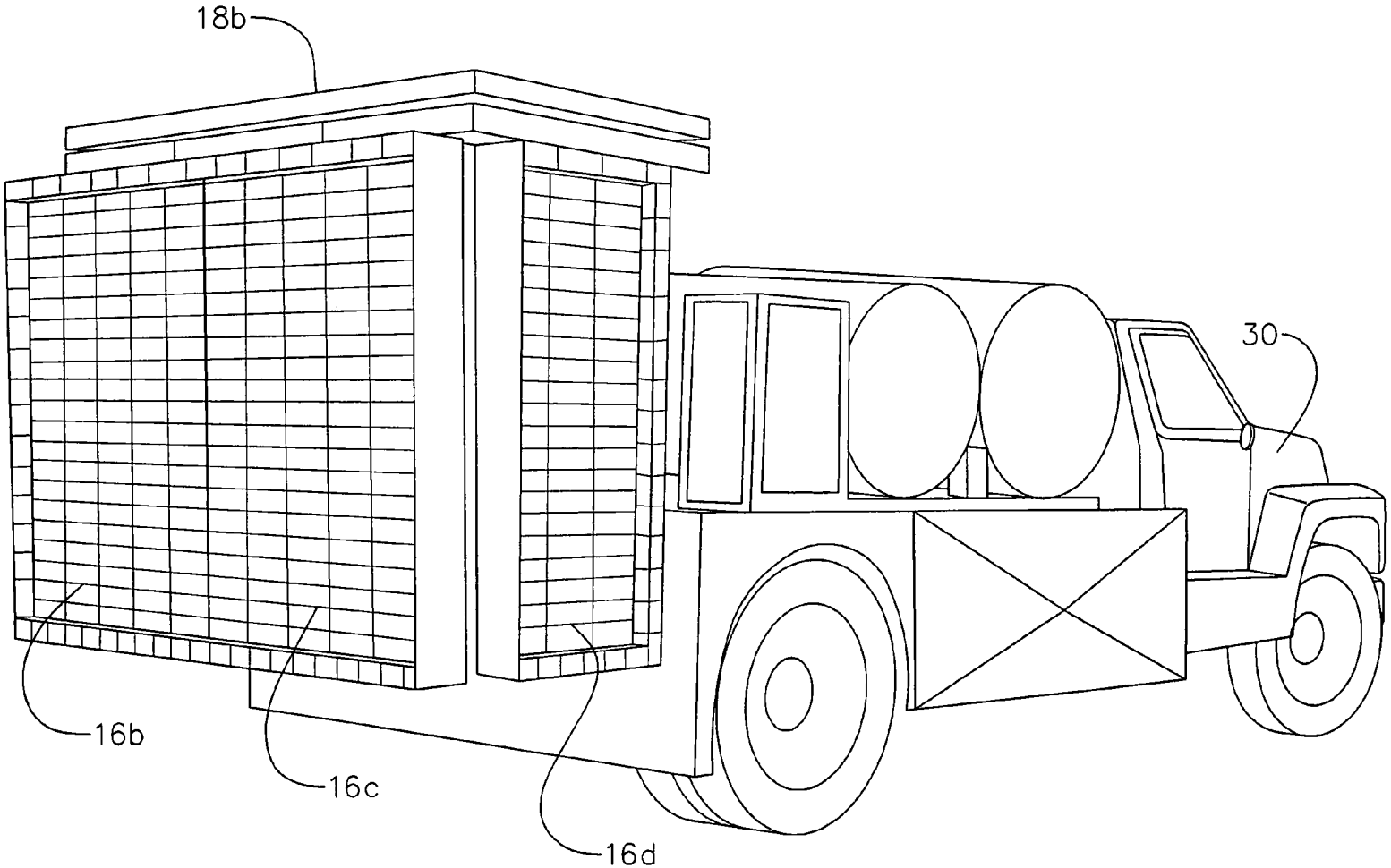
FIG. 4 is a perspective view of the truck of FIG. 1 wherein the heater is disposed in a transporting position.
Figures 5, 5A, 5B:
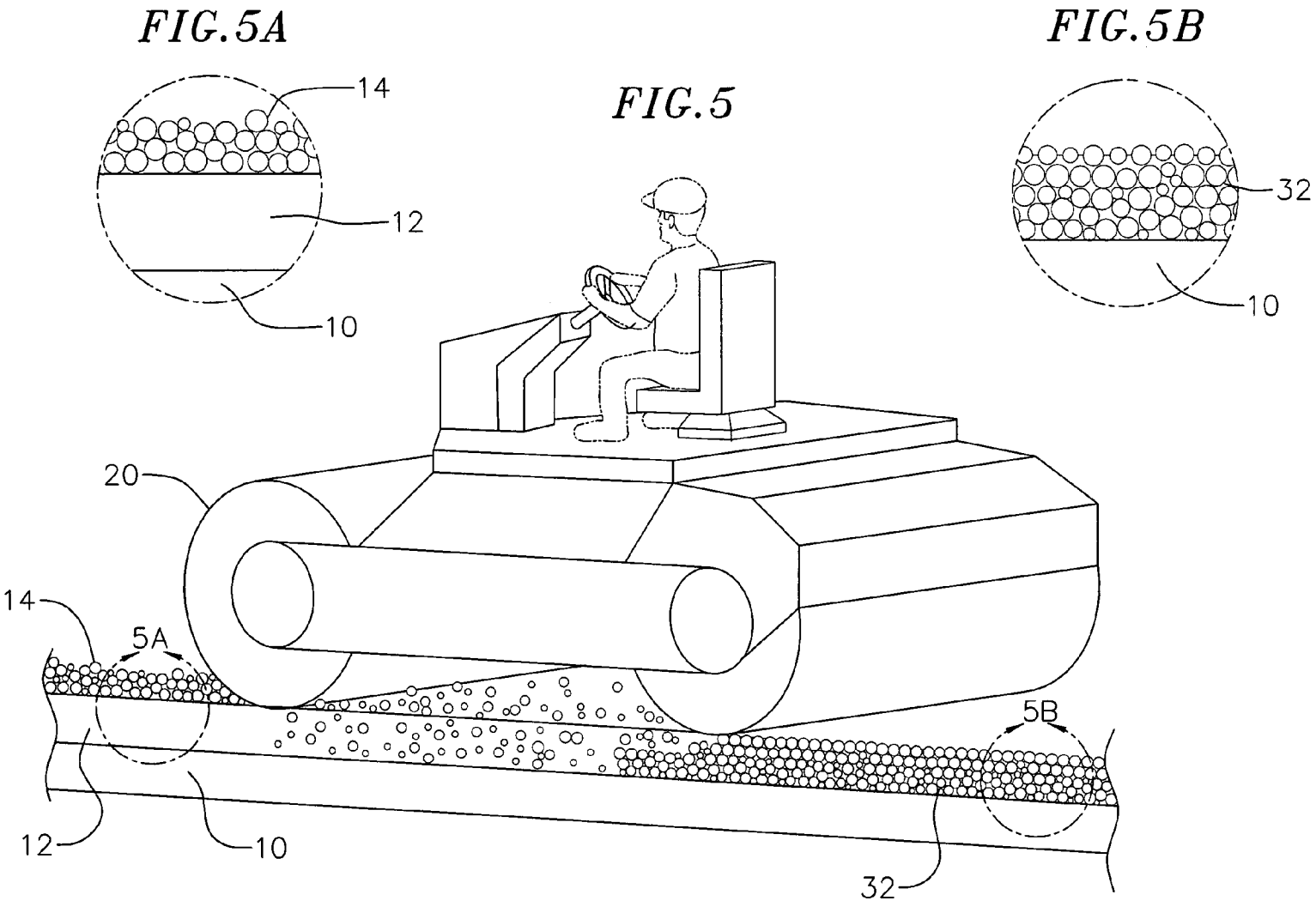
FIG. 5 is a somewhat schematic perspective view of the surface of FIG. 1 that has been coated with a layer of thermoplastic material and a layer of aggregate, and a roller (which can be either a steel drum or rubber tired or both) in the process of at least partially embedding the aggregate in the thermoplastic material to form thermoplastic-aggregate membrane.

In a preferred embodiment, the heater 16 and the insulated soaking panel 18 are attached to a vehicle or truck 30 (shown in FIG. 2). Within the truck 30 is a control panel for activating each of the heater zones 16*a*–16*d* and for angularly and vertically adjusting the heater 16 and the insulated soaking panel 18. Preferably, the heater 16 is connected to a hydraulic system (not shown) for angularly and vertically adjusting the heater 16 and the insulated soaking panel 18. The hydraulic system enables the heater 16 to be vertically adjustable above the aggregate 14, and angularly adjustable between a heating position (shown in FIG. 1) and a transporting position (shown in FIG. 4). For illustrative clarity, in FIG. 2 the heater 16 and insulated soaking panel 18 are shown at an angle of about forty-five degrees to the pavement. However, the heater 16 and insulated soaking panel 18 are typically disposed either in the heating position or the transporting position. In the heating position, the heater 16 and the insulated soaking panel 18 are approximately parallel to the pavement. In the traveling position, the heater 16 and the insulated soaking panel 18 are preferably approximately perpendicular to the pavement.

Preferably, the heater 16 and the insulated soaking panel 18 are collapsible to conform to legal dimensions for safe roadway travel. For example, since the heater 16 and the insulated soaking panel 18 are preferably approximately perpendicular to the pavement during transport of the vehicle 30, the insulated soaking panel 18 may be hingedly, telescopically or otherwise connected to the heater 16 such that the insulated soaking panel 18 may be lowered in height to reduce the overall height of the vehicle 30 during transport. In addition, the heating zones 16*a* and 16*d* may be hingedly, telescopically or otherwise connected to the heating zones 16*b* and 16*c*, respectively, and that the soaking panel sections 18*a* and 18*c* may be hingedly, telescopically or otherwise connected to the soaking panel section 18*b* such that the overall width of the vehicle 30 may be reduced during transport. Preferably, in the transporting position, the heater 16 and soaking panel 18 compact to a width in the range of about eight feet to about ten feet, and a height in a range of about eight feet to about twelve feet.

Figure 6:
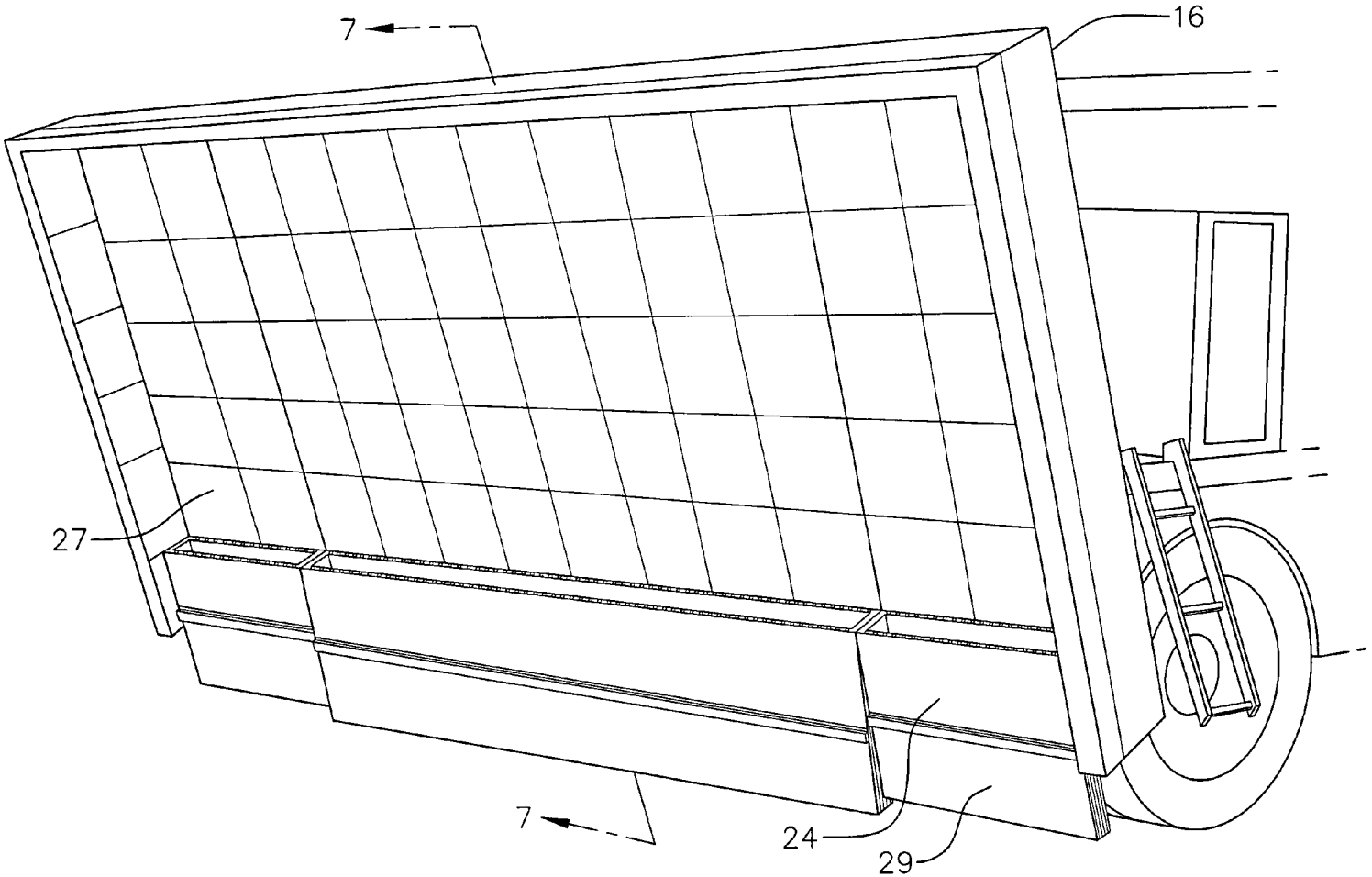
FIG. 6 is a rear perspective view of an alternative embodiment of a heater used in the method according to the present invention shown in a transporting position.
Figure 7:
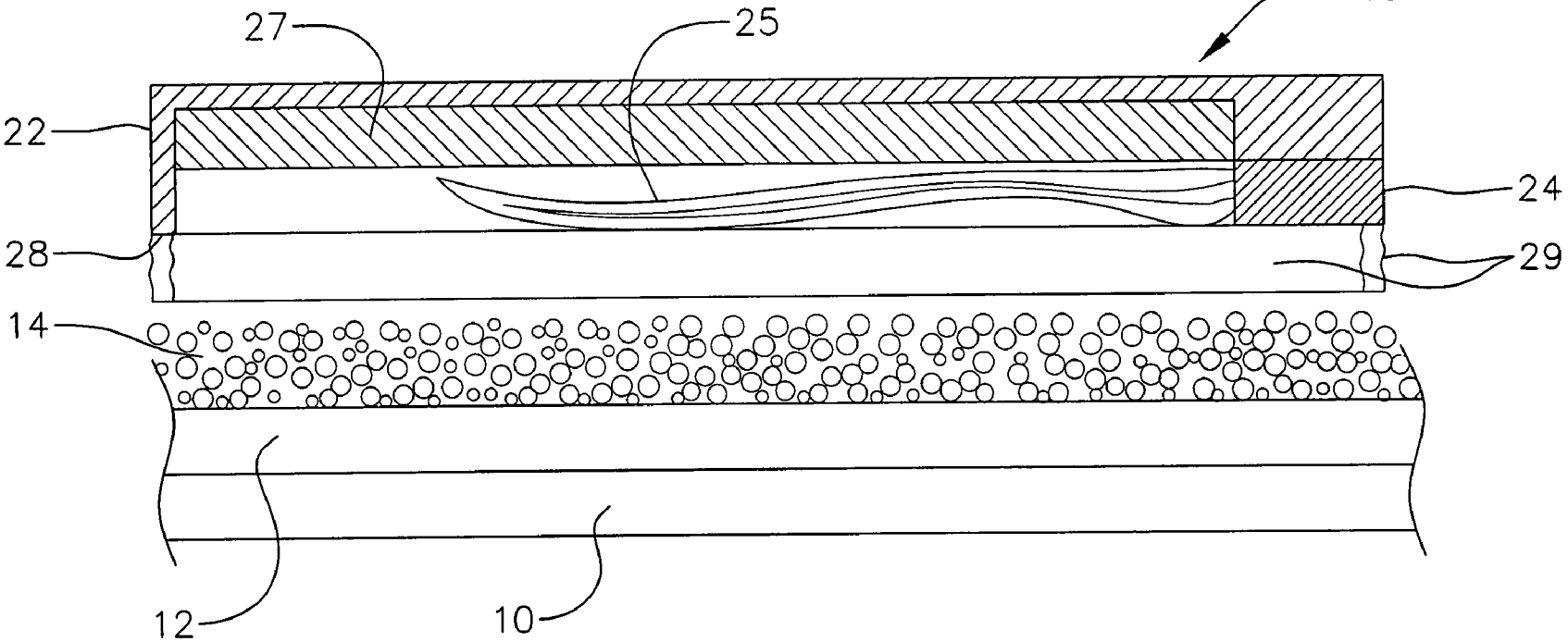
FIG. 7 is a cross-sectional view, taken in the direction of 7—7 of FIG. 6, of the heater of FIG. 6 shown in a heating position above a layer of aggregate, a thermoplastic paving material and a paving surface.

FIGS. 6-7 show an alternative embodiment of the heater 16. In this embodiment, the heater 24 is positioned within the housing 22, such that the flame(s) 25 of the heater is/are approximately perpendicular to the pavement facing surface 28 of the housing 22, i.e., when the heater 16 is in the heating position (shown in FIG. 1) the flame(s) 25 of the heater is/are approximately parallel to the surface 10 to be paved. As above, in a preferred embodiment, the flame(s) 25 protrude(s) no more than about one inch from the pavement facing surface 28 of the heater housing 22 to decrease the probability that the flame(s) 25 will ignite the oil in the thermoplastic material 12.

In this embodiment, the housing 22 may also comprise an insulating material 27, such as fiber glass battens. The insulating material 27 helps keep the gases that result from combustion close to the aggregate 14, over which the heater 16 is passed. The housing 22 of this embodiment, as well as previously described embodiments, may also comprise a curtain 29 for containing heat from the heater 16 above the surface 10 to be paved when the heater 16 is passed thereover. The curtain 29 protrudes downwardly from the housing 22 towards the surface 10 to be paved. The curtain 29 may be connected to the housing 22 by any one of a number fastening connections, such as a screw fastening connection or a clamping connection. As the heater 16 is passed above the aggregate 14, the curtain 29 passes in close proximity to the aggregate to effectively contain the heat of the heater 16. Although in FIG. 6 the curtain is illustrated as only extending from a leading edge of the housing 22, the curtain 29 may extend about an entire periphery of the housing 22 as illustrated in FIG. 7.

In a preferred embodiment, the thermoplastic material 12 comprises an asphalt paving oil mixed with recycled rubber. This mixture is a preferred paving material because of its superior physical properties and its potential as a solution to a major environmental problem, the disposal of scrap automobile and truck tires. A popular process for the use of such material is described in U.S. Pat. No. 3,891,585 and U.S. Pat. No. 4,069,182, both issued to Charles H. McDonald, the specifications of which are hereby incorporated by reference. According to a current form of this process, recycled crumb rubber obtained from scrap automobile tires is mixed with paving grade liquid asphalt (usually AR "Aged Residue" 4000) at a temperature of approximately 400 degrees F. (199 degrees C.) to form a jellied composition of "asphalt-rubber".

Preferably, before the thermoplastic material 12 is applied to the surface 10 to be paved, the surface 10 is cleaned, dried and prepared for paving. The thermoplastic material 12 may be applied to the surface 10 by any number of a variety of techniques. One such technique utilizes a commercially available distributor truck having a spray bar capable of spraying a layer of thermoplastic material 12 onto the surface 10 to be paved.

The spray bar (not shown) may comprise a main portion and a pair of side arms, the main portion and side arms having spray nozzles on their undersides for distributing the thermoplastic material 12 to the surface 10 to be paved.

Preferably, the aggregate 14 comprises crushed rock conforming to the following gradations in Table 1:

TABLE 1

Preferred Aggregate Specifications

| | Percentage Passing Sieve | | |
|---|---|---|---|
| Sieve Size | Coarse 12.5 mm (½") | Medium 9.5 mm (⅜") | Fine 9.5 mm (⅜") |
| 19.0 mm (¾") | 100 | 100 | — |
| 12.5 mm (½") | 90–100 | 95–100 | 100 |
| 9.5 mm (⅜") | 50–80 | 70–85 | 85–100 |
| 4.75 mm (No. 4) | 0–15* | 0–15* | 5–20* |
| 2.36 mm (No. 8) | 0–5 | 0–5 | 0–5 |
| 1.18 mm (No. 16) | — | — | — |
| 75 μm (No. 200) | 0–1 | 0–1 | 0–1 |

In Table 1, the superscript "*" indicates that the lower end of the specified range is preferable. Also in Table 1, the column labeled "Coarse" is recommended for industrial roadways, the column labeled "Medium" is recommended for highways, and the column labeled "Fine" is recommended for residential roadways. It is also preferred that the aggregate is coated with about 0.50 percent to about 2 percent Paving Grade AR-4000 asphalt to prevent free dust collection on the surface of the aggregate 14. The aggregate 14 may be spread over the thermoplastic material 12 by any number of a variety of techniques, such as by utilizing a commercially-available self-propelled aggregate-spreading machine that can be adjusted to accurately spread a specific amount of aggregate at a specific rate of spreading.

After the thermoplastic material 12 has been heated, for example to its softening point, the aggregate 14 is at least partially embedded in the thermoplastic material 12. This may be accomplished by a variety of methods, such as by utilizing the roller 20. In one exemplary embodiment, the roller 20 comprises a plurality of self-propelled, pneumatic-tired rollers. The tires of the pneumatic rollers may be inflated to about 690 kPa (100 pounds per square inch) and each roller may have an operating weight of about 7200 kg (16,000 pounds). A secondary roller may also be used to further embed the aggregate 14 at least partially in the thermoplastic material 12. The secondary roller may be a steel-drum roller weighing in the range of about 7.2 Tonnes (8 tons) to about 9.1 Tonnes (10 tons).

By embedding the aggregate 14 at least partially in the thermoplastic material 12, a thermoplastic-aggregate membrane 32 is formed. After the thermoplastic-aggregate membrane 32 is formed, sweeping may be performed to remove loose material without dislodging aggregate 14 set in the thermoplastic material 12.

Optionally, a rock dust blotter material may be applied to the thermoplastic-aggregate membrane 32 prior to opening the roadway to traffic, to prevent bleeding and pickup of the thermoplastic-aggregate material by passing vehicles.

Also optionally, a flush coat may be applied to the thermoplastic-aggregate membrane 32 prior to opening the roadway to traffic. The flush coat may comprise an application of fog seal coat and rock dust blotter material to the thermoplastic-aggregate membrane 32.

The preceding description has been presented with references to presently preferred embodiments of the invention. Persons skilled in the art and technology to which this invention pertains will appreciate that alterations and changes in the described structures or materials and compositions can be practiced without meaningfully departing from the principle, spirit and scope of this invention. For example, the thermoplastic material 12 may comprise a paving grade asphalt (e.g. AR-1000, AR-2000, AR-4000, AR-8000, or AR-16000 as set forth in Table 203-1.2(A) of the Standard Specifications for Public Works Construction) combined with a suitable synthetic polymer resin, such as:

- Whole Polymer
  - Block Copolymer
    - Styrene Butadiene Styrene (SBS)
    - Styrene Ethylene Styrene (SEBS)
    - Styrelf
  - Other Polymer
    - Polyethylene
    - Polypropylene
    - Epoxy Asphalt
    - Ethylene/Vinyl Acetate
    - Ductilad
    - Ethylene Propylene Rubber
  - Latex
    - Styrene Butadiene Rubber
    - Natural
    - Neoprene Specifically, such materials include Polymer Based Asphalt (PBA), Terminal Blend Asphalts, Modified Binders (MB) and MAC-10TR Binders. Accordingly, the foregoing description should not be read as pertaining only to the precise structures described and shown in the accompanying drawings, but rather should be read as consistent with aid as support for the following claims, which are to have their fullest and fairest scope.

The invention claimed is:

1. A paving method comprising:

applying a layer of liquid thermoplastic material to a surface to be paved;

covering the thermoplastic material with a layer of aggregate, precoated or otherwise;

passing a heater above the aggregate and thermoplastic material to heat the thermoplastic material;

heating the thermoplastic material at least to its softening point; and passing at least one roller over the aggregate before the thermoplastic material cools below its softening point to force the aggregate at least partially into the thermoplastic material.

2. The method of claim 1, wherein the heater heats the thermoplastic material to a temperature of at least about 140° Fahrenheit.

3. The method of claim 1, wherein the heater uniformly distributes heat when the heater is passed above the aggregate and thermoplastic material.

4. The method of claim 1, wherein the heater uniformly distributes heat in a range of five to nine million British Thermal Units per hour.

5. The method of claim 1, wherein the heater has a width in a range of about 10 to about 14 feet.

6. The method of claim 1, wherein the heater is passed above the aggregate at a rate in a range of 60 to 95 feet per minute.

7. The method of claim 1, wherein the heater is adjustable in height and the height of the heater is uniform along a width of the heater.

8. The method of claim 1, wherein the beater comprises a heat source that indirectly beats the thermoplastic material when the heater passes above the aggregate and thermoplastic material.

9. The method of claim 8, wherein the heater comprises a housing and that houses the heat source such that the heat source produces a flame that protrudes no more than about 1 inch from a pavement facing surface of the housing.

10. The method of claim 1, wherein the heat source is an L.P.G. fueled open flame burner.

11. The method of claim 1, wherein the heater comprises a housing that houses a heat source and a plurality of heating bricks.

12. The method of claim 11, wherein, the plurality of hearing bricks are disposed between the aggregate and the heat source such that, when activated, the hear source heats the bricks, which in turn heat the thermoplastic material, such that the thermopiastic material is indirectly heated by the heat source.

13. The method of claim 11, wherein the heater is collapsible to conform to legal dimensions for safe roadway travel.

14. The method of claim 13, wherein the heater compacts to a width in a range of about 8 to about 10 feel and a height in a range of about 8 to about 12 feet.

15. The method of claim 1, wherein the heater comprises a heat source that produces one or more flames tat are approximately parallel to the surface to be paved when the heater passes above the aggregate and thermoplastic maternal.

16. The method of claim 15, wherein the heater comprises an insulating material disposed adjacent to the heat source.

17. The method of claim 15, wherein the heater comprises a curtain to aid in containing heat from the heater above the surface to be paved when the heater is passed thereover.

18. The method of claim 14, wherein the heater and panel compact to a width in a range of about 8 to about 10 feet and a height in a range of about 8 to about 12 feet.

19. The method of claim 1, wherein passing at least one roller over the aggregate comprises passing a first roller and a second roller or more over the aggregate to at least partially embed the aggregate in the thermoplastic material.

20. The method of claim 19, wherein the first roller comprises at least one self-propelling pneumatic tire and the second roller is a steel drum roller.

21. A paving method comprising:

applying a layer of liquid thermoplastic material to a surface to be paved;

covering the thermoplastic material with a layer of aggregate, precoated or otherwise;

passing a heater above the aggregate and thermoplastic material to indirectly heat the thermoplastic material;

heating the thermoplastic material at least to its softening point; and passing at least one roller over the aggregate before the thermoplastic material cools below its softening point to force the aggregate at least partially into the thermoplastic material.

22. The method of claim 21, wherein the heater uniformly distributes heat in a range of five to nine million British thermal units per hour.

23. The method of claim 21, wherein the heater is passed above the aggregate and thermoplastic material at a rate in a range of 60 to 95 feet per minute.

24. The method of claim 22, wherein the heater comprises a housing and that houses the heat source, such that the heat source produces a flame that protrudes no more than about 1 inch from a pavement facing surface of the housing.

25. The method of claim 21, wherein the heater comprises a heat source and a plurality of heating bricks, the plurality of heating bricks being disposed between the aggregate and the heat source such that, when activated, the heat source heats the bricks, which in turn heat the thermoplastic material, such that the thermoplastic material is indirectly heated by the heat source.

26. The method of claim 21, wherein passing at least one roller over the aggregate comprises passing a first roller and a second roller or more over the aggregate to at least partially embed the aggregate in the thermoplastic material, wherein the first roller comprises at least one self propelling pneumatic tire and the second roller is a steel drum roller.

27. The method of claim 21, wherein the heater comprises a heat source that produces one or more flames that are approximately parallel to the surface to be paved when the heater passes above the aggregate and thermoplastic material.

28. A paving method comprising:

applying a layer of liquid thermoplastic material to a surface to be paved;

covering the thermoplastic material with a layer of aggregate, precoated or otherwise;

passing a heater above the aggregate and thermoplastic material to heat the thermoplastic material; heating the thermoplastic material at least to its softening point and passing at least one toiler over forcing the aggregate before the thermoplastic material cools below its softening point to force the aggregate at least partially into the thermoplastic material, wherein the layer of aggregate consists essentially of aggregate with no more than two percent of said layer of aggregate being a polymeric coating.

29. A paving method comprising:

applying a layer of liquid thermoplastic material to a surface to be paved;

covering the thermoplastic material with a layer of aggregate, precoated or otherwise;

passing a heater above the aggregate and thermoplastic material to indirectly heat the thermoplastic material;

heating the thermoplastic material at least to its softening point; and passing at least one roller over the aggregate before the thermoplastic material cools below its softening point to force the aggregate at least partially into the thermoplastic material, wherein the layer of aggregate consists essentially of aggregate with no more than approximately two percent of said layer of aggregate being a polymeric coating.

* * * * *

UNITED STATES PATENT AND TRADEMARK OFFICE

CERTIFICATE OF CORRECTION

PATENT NO. : 7,033,104 B2
APPLICATION NO. : 10/253304
DATED : April 25, 2006
INVENTOR(S) : Corcoran It is certified that error appears in the above-identified patent and that said Letters Patent is hereby corrected as shown below:

In the Specification

| | |
|---|---|
| Column 1, line 22 | Delete “membrane:”,<br>Insert --membrane-- |
| Column 1, line 23 | Delete “aggregate:”,<br>Insert --aggregate-- |
| Column 3, line 56 | Delete “L.P.G.”,<br>Insert --L.N.G.-- |
| Column 4, line 27 | Delete “one half”,<br>Insert --one-half-- |
| Column 5, Line 20 | Delete “that” |
| Column 7, line 36 | Delete “aid”,<br>Insert --and-- |

In the Claims

| | |
|---|---|
| Column 8, line 4, Claim 8 | Delete “beater”,<br>Insert --heater-- |
| Column 8, line 5, Claim 8 | Delete “beats”,<br>Insert --heats-- |
| Column 8, line 17, Claim 12 | Delete “wherein,”,<br>Insert --wherein-- |
| Column 8, line 18, Claim 12 | Delete “hearing”,<br>Insert --heating-- |
| Column 8, line 21, Claim 12 | Delete “thermopiastic”,<br>Insert --thermoplastic-- |
| Column 8, line 27, Claim 14 | Delete “feel”,<br>Insert --feet-- |
| Column 8, line 30, Claim 15 | Delete “tat”,<br>Insert --that-- |

UNITED STATES PATENT AND TRADEMARK OFFICE

CERTIFICATE OF CORRECTION

PATENT NO. : 7,033,104 B2
APPLICATION NO. : 10/253304
DATED : April 25, 2006
INVENTOR(S) : Corcoran It is certified that error appears in the above-identified patent and that said Letters Patent is hereby corrected as shown below:

| | |
|---|---|
| Column 8, lines 32-33, Claim 15 | Delete "maternal",<br>Insert --material-- |
| Column 9, line 2, Claim 24 | Delete "and that",<br>Insert --that-- |
| Column 10, line 2, Claim 28 | Delete "toiler over forcing",<br>Insert --roller over-- |

Signed and Sealed this

Thirtieth Day of October, 2007

JON W. DUDAS
*Director of the United States Patent and Trademark Office*